US008601987B2

(12) United States Patent
Steiner et al.

(10) Patent No.: US 8,601,987 B2
(45) Date of Patent: Dec. 10, 2013

(54) INTERNAL COMBUSTION ENGINE WITH LIQUID COOLING

(75) Inventors: Bernd Steiner, Bergisch Gladbach (DE); Kai Sebastian Kuhlbach, Bergisch Gladbach (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 185 days.

(21) Appl. No.: 13/099,702

(22) Filed: May 3, 2011

(65) Prior Publication Data

US 2011/0271916 A1 Nov. 10, 2011

(30) Foreign Application Priority Data

May 4, 2010 (EP) ..... 10161879

(51) Int. Cl.
*F02F 1/40* (2006.01)

(52) U.S. Cl.
USPC ..... 123/41.82 R; 123/41.29; 123/41.57; 123/196 AB

(58) Field of Classification Search
USPC ..... 123/41.82 R, 41.33, 41.74, 41.84, 41.42, 123/41.29
See application file for complete search history.

(56) References Cited

U.S. PATENT DOCUMENTS

| | | | | |
|---|---|---|---|---|
| 4,760,833 | A * | 8/1988 | Tatyrek | 123/574 |
| 4,813,408 | A * | 3/1989 | Katsumoto et al. | 123/196 AB |
| 4,964,378 | A * | 10/1990 | Tamba et al. | 123/41.57 |
| 5,477,820 | A * | 12/1995 | Rao | 123/193.6 |
| 5,687,686 | A * | 11/1997 | Takahashi | 123/195 P |
| 5,709,185 | A * | 1/1998 | Aizawa et al. | 123/196 R |
| 7,047,955 | B2 * | 5/2006 | Ookawa et al. | 123/572 |
| 7,269,496 | B2 * | 9/2007 | Honda et al. | 701/104 |

* cited by examiner

*Primary Examiner* — Thanh Truong
*Assistant Examiner* — Omar Morales
(74) *Attorney, Agent, or Firm* — Julia Voutyras; Alleman Hall McCoy Russell & Tuttle LLP

(57) ABSTRACT

A system for providing cooling to at least one cylinder of an engine is disclosed. The system comprises at least one coolant jacket in a cylinder head arranged on an inlet side of a cylinder and at least one coolant jacket in the cylinder head arranged on an outlet side of the cylinder. The outlet-side coolant jacket may be part of a water cooling circuit, while the inlet-side coolant jacket may be part of an oil circuit.

20 Claims, 6 Drawing Sheets

INTERNAL COMBUSTION ENGINE WITH LIQUID COOLING

RELATED APPLICATIONS

This application claims priority to European Patent Application No. 10161879.1 filed on May 4, 2010, the entire contents of which being incorporated herein by reference.

FIELD

The present disclosure relates to systems and methods for providing engine cooling.

BACKGROUND AND SUMMARY

A main engine oil gallery may be provided in an engine to supply engine components such as a camshaft and crankshaft with lubricating oil. In order to reduce oil viscosity and thus lower the energy required to pump the oil, engines may be provided with systems to heat the oil. For example, an external heater may be provided to heat the oil in the oil gallery. However, the external heater itself requires energy to function and therefore contributes to overall fuel usage in the engine, lowering fuel economy. In other concepts, the engine oil which is heated during operation is stored in an insulated container and utilized on demand, for example in the event of a re-start of the internal combustion engine. A disadvantage of this approach is that the oil which is heated during operation cannot be kept at a high temperature indefinitely, and it is therefore generally necessary to heat the oil during the operation of the internal combustion engine. Additionally, both an external heating device and also an insulated container result in an additional installation space requirement in the engine bay, and are detrimental to the attainment of the densest possible packaging of the drive unit.

Further, engine combustion cylinders may be provided with mechanisms to dissipate excess heat produced during combustion. However, the cooling may not extract more heat from the internal combustion engine than is absolutely necessary, because the extraction of heat or the extracted amount of heat has an influence on the efficiency of the internal combustion engine. In some engines, more than one quarter of the energy used is dissipated to the coolant, that is to say generally to the cooling water, of the liquid cooling arrangement and is dissipated, unused, to the environment.

The inventors herein have recognized the above mentioned issues and have developed a solution to at least partly address them. Accordingly, an internal combustion engine is provided. The engine comprises at least one cylinder, each cylinder having an outlet opening on an outlet side for discharging exhaust gases and an inlet opening on an inlet side for receiving fresh air, at least one cylinder head, and a liquid cooling device comprising at least two coolant jackets integrated in the cylinder head, wherein at least one coolant jacket is arranged on the inlet side of the at least one cylinder and at least one coolant jacket is arranged on the outlet side of the at least one cylinder, the at least two coolant jackets being separate from one another and belonging to different coolant circuits.

For example, the coolant jacket arranged on the inlet side may belong to an oil coolant circuit while the coolant jacket arranged on the outlet side may belong to a water coolant circuit. In this manner, engine oil may be rapidly heated via heat transfer through the inlet side coolant circuit. Additionally, as water has a higher heat capacity than oil, the water coolant circuit may be able to provide a higher level of cooling to the outlet side of the cylinder than the oil coolant circuit provides to the inlet side of the cylinder. Because the inlet side of the cylinder may not release as much as heat as the outlet side, an appropriate amount of cooling can be tailored to each cylinder side, reducing excess cooling and conserving energy.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

An internal combustion engine is used as a drive for motor vehicles. Within the context of the present disclosure, the expression "internal combustion engine" encompasses diesel engines and spark-ignition engines and also hybrid internal combustion engines, that is to say internal combustion engines which are operated using a hybrid combustion process.

Figure 1:
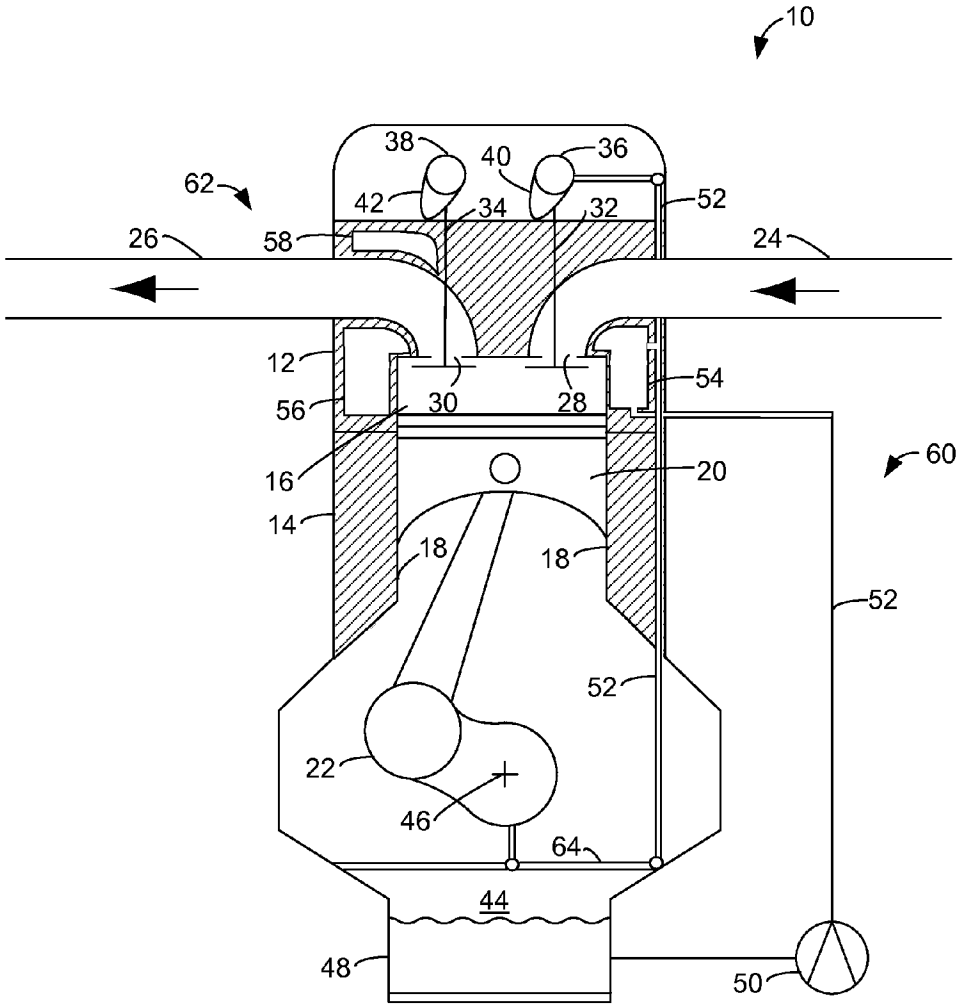
FIG. 1 schematically shows a cylinder of an internal combustion engine according to an embodiment of the present disclosure.

FIG. 1 is a schematic diagram showing one cylinder of a multi-cylinder engine 10, which may be included in a propulsion system of an automobile. The cylinder 16 has a cylinder head 12 and a cylinder block 14 which are connected to one another at their assembly end sides so as to form a combustion chamber.

Combustion chamber (i.e. cylinder) 16 of engine 10 may include combustion chamber walls 18 with piston 20 positioned therein. Piston 20 may be coupled to crankshaft 22 so that reciprocating motion of the piston is translated into rotational motion of the crankshaft. Crankshaft 22 may be coupled to at least one drive wheel of a vehicle via an intermediate transmission system. Further, a starter motor may be coupled to crankshaft 22 via a flywheel to enable a starting operation of engine 10.

Combustion chamber 16 may receive intake air from an intake manifold (not shown) via intake line, or intake passage, 24 and may exhaust combustion gases via exhaust line, or exhaust passage, 26. Intake passage 24 and exhaust passage 26 can selectively communicate with combustion chamber 16 via inlet opening 28 and outlet opening 30 and respective intake valve 32 and exhaust valve 34. In some examples, combustion chamber 16 may include two or more intake valves and/or two or more exhaust valves.

During operation, each cylinder within engine 10 typically undergoes a four stroke cycle: the cycle includes the intake stroke, compression stroke, expansion stroke, and exhaust stroke. During the intake stroke, generally, the exhaust valve 34 closes and intake valve 32 opens. Air is introduced into combustion chamber 16 via intake passage 24, and piston 20 moves to the bottom of the cylinder so as to increase the volume within combustion chamber 16. The position at which piston 20 is near the bottom of the cylinder and at the end of its stroke (e.g. when combustion chamber 16 is at its largest volume) is typically referred to by those of skill in the art as bottom dead center (BDC). During the compression stroke, intake valve 32 and exhaust valve 34 are closed. Piston 20 moves toward the cylinder head so as to compress the air within combustion chamber 16. The point at which piston 20 is at the end of its stroke and closest to the cylinder head (e.g. when combustion chamber 16 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as a spark plug (not shown), resulting in combustion. During the expansion stroke, the expanding gases push piston 16 back to BDC. Crankshaft 22 converts piston movement into a rotational torque of the rotary shaft. Finally, during the exhaust stroke, the exhaust valve 34 opens to release the combusted air-fuel mixture to exhaust passage 26 and the piston returns to TDC. Note that the above is shown merely as an example, and that intake and exhaust valve opening and/or closing timings may vary, such as to provide positive or negative valve overlap, late intake valve closing, or various other examples.

A valve actuating device depicted in FIG. 1 comprises two camshafts 36 and 38, on which a multiplicity of cams 40, 42 are arranged. A basic distinction is made between an underlying camshaft and an overhead camshaft. This relates to the parting plane, that is to say assembly surface, between the cylinder head and cylinder block. If the camshaft is arranged above said assembly surface, it is an overhead camshaft, otherwise it is an underlying camshaft. Overhead camshafts are preferably mounted in the cylinder head, and are depicted in FIG. 1.

The cylinder head 12 is connected, at an assembly end side, to a cylinder block 14 which serves as an upper half of a crankcase 44 for holding the crankshaft 22 in at least two bearings, one of which is depicted as crankshaft bearing 46. At the side facing away from the cylinder head 12, the cylinder block 14 is connected to an oil pan 48 which serves as a lower crankcase half and which is provided for collecting and storing engine oil. The oil pan 48 serves as a heat exchanger for reducing the oil temperature when the internal combustion engine 10 has warmed up. Here, the oil situated in the oil pan 48 is cooled by means of heat conduction and convection by means of an air flow conducted past the outer side.

A pump 50 is provided for feeding the engine oil via a supply line 52 to a main engine oil gallery 64. The engine oil gallery 64 may be arranged above or below the crankshaft 22 in the crankcase 44 or else integrated into the crankshaft 22. Ducts lead from the main oil gallery to feed at least one consumer within an oil circuit 60. Example oil consumers include bearings of the camshaft and crankshaft, hydraulically actuable camshaft adjusters or other valve drive components, etc. In contrast, according to other systems, the supply line leads from the pump through the cylinder block to the camshaft receptacle, and in so doing, passes the so-called main oil gallery.

In previous systems, the pump which is provided is itself provided with engine oil originating from an oil pan via a suction line which leads from the oil pan to the pump, and said pump ensures an adequately high feed flow, that is to say an adequately high feed volume, and an adequately high oil pressure in the supply system, that is to say oil circuit, in particular in the main oil gallery.

The cylinder head 12 and the cylinder block 14 are thermally highly loaded components which require cooling, and the thermal management of the internal combustion engine is dominated primarily by said cooling, that is to say the configuration of the internal combustion engine is determined by the cooling and not by other thermal management issues, such as fast heating of the engine oil.

The heat released during the combustion by the exothermic, chemical conversion of the fuel is dissipated partially to the cylinder head 12 and cylinder block 14 via the walls 18 which delimit the combustion chamber and partially to the adjacent components and the environment via the exhaust-gas flow. To keep the thermal loading of the cylinder head 12 within limits, a part of the heat flow introduced into the cylinder head 12 may be extracted from the cylinder head again. The amount of heat dissipated to the environment from the surface of the internal combustion engine by radiation and heat conduction is not adequate for efficient cooling, for which reason cooling of the cylinder head is generally effected in a targeted manner by means of forced convection.

The cylinder head 12 of the internal combustion engine according to the disclosure has two coolant circuits which are independent of one another and which comprise in each case at least one coolant jacket, and which in particular can be and preferably are operated with different coolants. One coolant jacket 54 is located on an inlet side of the cylinder, that is, the coolant jacket is integrated into the cylinder head 12 at the side of the cylinder that is adjacent to and surrounding the intake passage 24. Another coolant jacket 56 is located on an outlet side of the cylinder, that is, the coolant jacket 56 is integrated into the cylinder head 12 at the side of the cylinder that is adjacent to and surrounding the exhaust passage 26. The cylinder head may further have an upper outlet side coolant jacket 58. The first, lower coolant jacket 54 may be arranged between the exhaust passage 26 and the assembly end side of the cylinder head 12, and the upper coolant jacket 58, may be arranged on that side of the exhaust passage 26 which is situated opposite the lower coolant jacket 56.

This arrangement leaves free an adequate amount of installation space on that side of the cylinder head 12 which faces away from the block 14, for example for the arrangement of a camshaft receptacle, and leads to a compact design.

Figure 3:
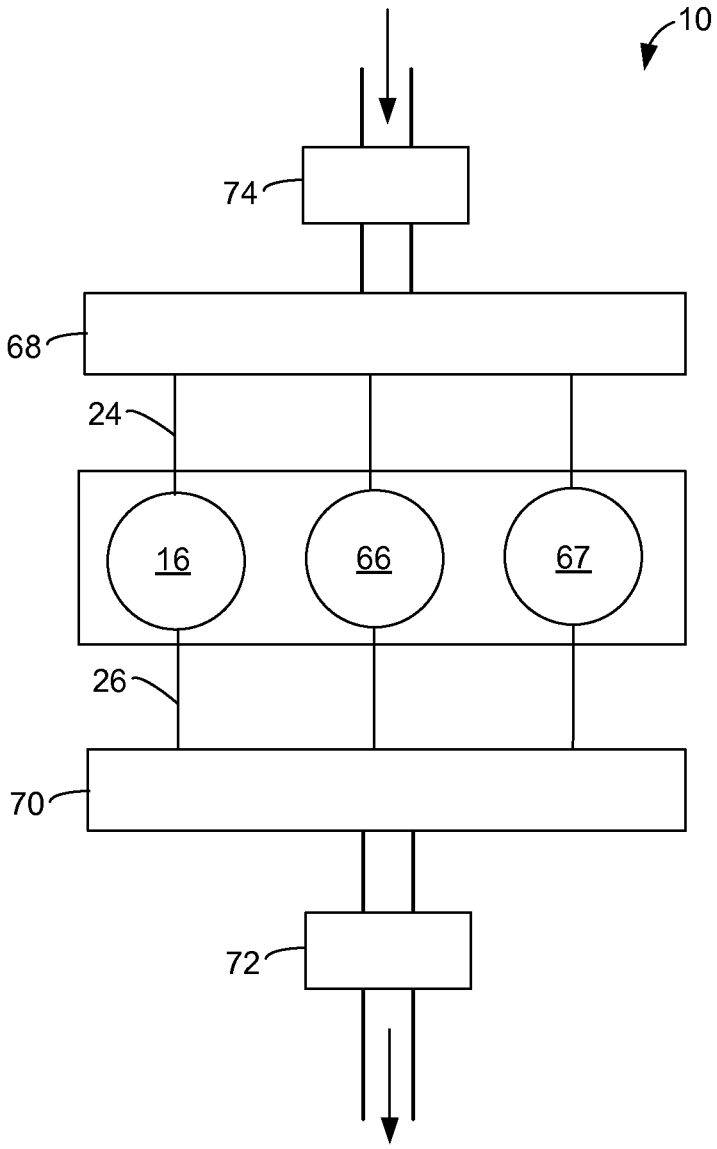
FIG. 3 schematically shows multiple cylinders of the internal combustion engine of FIG. 1.

In some embodiments, at least one connection may be provided between the upper and lower coolant jackets 56, 58 to permit passage of a coolant (shown in FIG. 3). The at least one connection is preferably situated on that side of the coolant jackets which face away from the cylinders.

As a result of the provision of a connection, it is possible to form a very efficient cooling arrangement such as is required by thermally highly loaded internal combustion engines, for example supercharged internal combustion engines, which are equipped with an integrated exhaust manifold.

The cooling arrangement may reliably protect the internal combustion engine, in particular the cylinder head 12, against thermal overloading, and may preferably be efficient enough that an enrichment ($\lambda<1$) at high exhaust-gas temperatures can be dispensed with. During the course of an enrichment, more fuel is injected than can actually be burned with the provided air quantity, with the additional fuel likewise being heated and evaporated, such that the temperature of the combustion gases falls. Said approach is however considered to be disadvantageous from energy-related aspects, in particular with regard to the fuel consumption of the internal combustion engine 10, and with regard to pollutant emissions. In particular, the enrichment does not always make it possible to operate the internal combustion engine 10 in such a way as would be required for example for a provided exhaust-gas aftertreatment system.

This configuration or design of the liquid cooling arrangement makes it possible for the inlet side on the one hand and the outlet side on the other hand to be cooled as required, specifically independently of one another and according to the respective demand profile.

According to the present disclosure, the at least one coolant jacket 56 of one circuit is arranged at the outlet side and the at least one coolant jacket 54 of the other circuit is arranged at the inlet side, such that different cooling capacities can be realized for the inlet side and the outlet side, specifically not only through the use of different coolants. Moreover, the pump power of each circuit, and therefore also the coolant throughput, that is to say the feed volume, can be selected and set independently of one another. In this way, it is possible to influence the throughflow speed, which significantly co-determines the heat transfer by convection.

In this way, it is possible for less heat to be extracted from the cylinder head 12 at the inlet side and more heat to be extracted from the cylinder head 12 at the outlet side.

In particular, the internal combustion engine 10 according to the disclosure permits the use of oil as coolant for the inlet side in an oil circuit 60 and the use of water as coolant in a water circuit 62 for the thermally more highly or highly loaded outlet side of the cylinder head 12. In this embodiment, the cooling water circuit 62 does not comprise an inlet-side coolant jacket. That is to say, the inlet side of the cylinder head 12 is exclusively oil cooled, for which reason the heat is not dissipated unused with the cooling water. Conversely, the oil circuit 60 may not comprise an outlet-side coolant jacket.

Oil has a lower heat capacity than water, as a result of which the cooling capacity at the inlet side can be reduced noticeably in relation to the use of water as coolant. This configuration of the liquid cooling arrangement makes it possible for heat to be extracted from the cylinder head 12 at the inlet side to the extent actually required to prevent overheating. In contrast, in previous systems, on account of the uniform use of water as coolant, the inlet side is cooled more intensely than is actually required, because the cooling arrangement is designed with regard to the thermally more highly loaded outlet side. The internal combustion engine 10 according to the disclosure is therefore optimized with regard to cooling. The efficiency of the internal combustion engine 10 is increased by the liquid cooling arrangement according to the disclosure.

Furthermore, the use of oil as coolant for the at least one inlet-side coolant jacket 54 has a further advantage. If the inlet-side coolant jacket 54 jointly forms the oil circuit 60 of the internal combustion engine, which oil circuit 60 supplies oil to consumers via a supply line 52, the engine oil is heated up more quickly after a cold start.

The oil specifically then flows, as it passes the cylinder head 12, through the inlet-side coolant jacket 54, the most innate function of which is the presently desired heat transfer. Here, the inlet-side coolant jacket 54 is utilized for heating the oil during the warm-up phase, and corresponding to its original function, for cooling the cylinder head 12 when the internal combustion engine 10 has warmed up. In both cases, the inlet-side coolant jacket 54 serves for introducing heat into the oil.

While the heat which is introduced into the coolant at the inlet side after a cold start advantageously ensures fast heating of the oil, and therefore improves the operation of the internal combustion engine 10. The heat which, in previous systems, is introduced into the cooling water serving as coolant is dissipated unused. The latter heat transfer even counteracts a fast heating of the oil. The heating of the oil during the warm-up phase is slowed here because a warm-up of the internal combustion engine, and therefore also heating of the oil as it passes the cylinder head or cylinder block, is counteracted.

With regard to the heating of the oil during the warm-up phase, the inlet-side coolant jacket 54 has out of principle proven to be extremely suitable. Firstly, the inlet-side coolant jacket 54 has an expanded volume region to provide a large surface area, in particular in comparison with an oil supply line, which has a relatively small surface area. The expanded volume region may extend from an area adjacent to the intake passage 24 down to the assembly end side of the cylinder head 12, and may substantially surround an area around an intake passage port. This increased surface area increases the heat transfer by convection. Secondly, the cylinder head 12 into which the coolant jacket 54 is integrated is thermally particularly highly loaded, which promotes the introduction of heat into the engine oil during the warm-up phase on account of the comparatively large temperature difference or temperature gradient.

Therefore, for the reasons stated above, embodiments of the internal combustion engine are particularly advantageous in which the at least one outlet-side coolant jacket 56 belongs to a cooling water circuit 62, whereas the at least one inlet-side coolant jacket 54 belongs to an oil circuit 60. The two coolant circuits, specifically the cooling water circuit 62 on the one hand and the cooling oil circuit 60 on the other hand, are separate from one another.

Thus, the oil circuit 60 comprises the oil pan 48, which provides oil to the oil pump. The supply line 52, upstream of the main oil gallery 64, leads through the cylinder head 12, preferably through the inlet-side coolant jacket 54 of the cylinder head 12. The supply line 52 of the oil circuit 60 firstly leads through the cylinder head 12 before said supply line 52 enters into the cylinder block 14. The supply line 52 opens out, downstream, into the main oil gallery 64.

In the oil circuit 60, the oil is heated in the cylinder head 12 and then is it used for lubricating engine components, such as the bearings 46 of the crankshaft 22. While it is the case in the systems described previously that the engine oil flows from the main oil gallery to the cylinder head, in the present case, said oil is conducted from the cylinder head 12 to the main oil gallery 64, which reduces the friction in the bearings and reduces fuel consumption.

To supply the camshafts 36, 38 with oil, the supply line 52 may further lead from the inlet-side coolant jacket 54 to the camshafts 36, 38.

This embodiment makes use of the fact that the cylinder head 12 is thermally highly loaded, in particular is thermally more highly loaded than the cylinder block 14, such that the heating of the oil, that is to say the rise in the oil temperature, as said oil flows through the cylinder head 12 is more pronounced than when said oil flows through the cylinder block 14.

After a cold start, the cylinder head 12 warms up more quickly, in particular in relation to the cylinder block 14, as a result of the combustion processes taking place. The embodiment in FIG. 1 ensures that the crankshaft bearings 46 are supplied with pre-heated oil more quickly, and in particular prevents a situation in which the oil entering into the cylinder head 12 has heat extracted from it upstream in the cylinder block 14.

Figure 2:
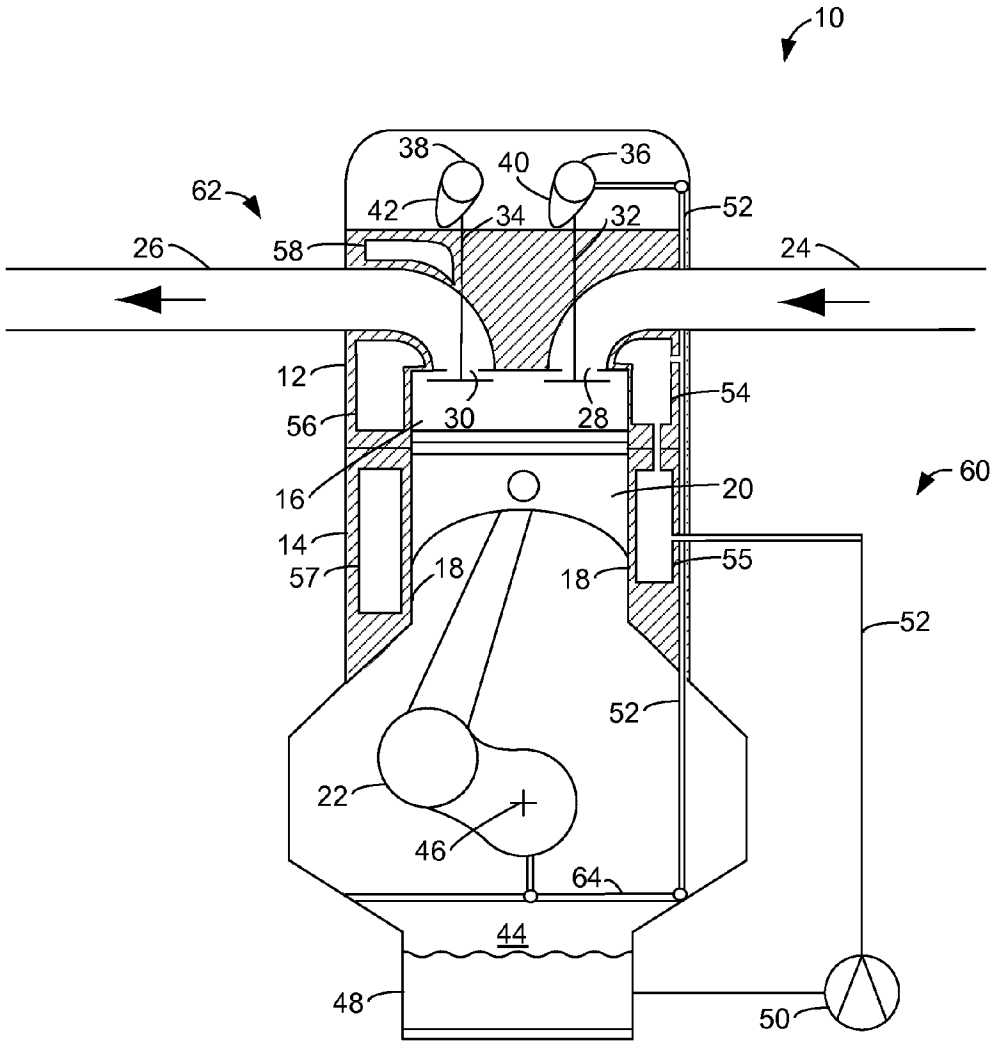
FIG. 2 schematically shows a cylinder of an internal combustion engine according to another embodiment of the present disclosure.

In another embodiment, depicted in FIG. 2, the supply line 52 may lead firstly through the cylinder block 14 and subsequently, that is to say downstream, through the cylinder head 12, preferably through the inlet-side coolant jacket 54.

In addition to the coolant jackets 54, 56, 58 arranged in the cylinder head 12, in some embodiments, the cylinder block 14 may include cooling jackets. In addition to the cylinder head 12, the cylinder block 14 is also a thermally highly loaded component, such that the cylinder block 14 may also be equipped with one or more coolant jackets in order to form a liquid cooling arrangement. This may be advantageous in particular if it is sought to use less temperature-resistant materials, or in supercharged internal combustion engines, which are thermally more highly loaded than naturally-aspirated engines.

The cylinder block 14 may comprise an outlet-side coolant jacket 57 on the outlet side as part of the cooling water circuit 62. The coolant jacket 57 of the cylinder block 14 may be arranged upstream of the at least one coolant jacket 56 of the cylinder head 12, or it may be arranged downstream. In other embodiments, the cylinder block 14 may comprise an inlet-side coolant jacket 55 as part of the oil circuit 60. The coolant jacket 55 of the cylinder block 14 may be arranged upstream of the at least one coolant jacket 54 of the cylinder head 12, or it may be arranged downstream. In some embodiments, the cylinder block may comprise both coolant jackets 55, 57. The arrangement of the cylinder block 14 and head 12 or flow direction of the coolant is dependent on the individual situation, in particular also on what coolant is used and what cooling circuit the coolant jacket of the block 14 belongs to.

Turning to FIG. 3, the engine 10 described with reference to FIG. 1 is depicted. Here, all cylinders of engine 10 are shown. In addition to cylinder 16, cylinders 66, 67 are depicted. While engine 10 is here depicted as a three-cylinder engine, it is to be understood that any number of cylinders in any arrangement is within the scope of this disclosure.

An intake manifold 68 provides intake air to the cylinders via intake passages, such as intake passage 24. After combustion, exhaust gasses exit the cylinders via exhaust passages, such as exhaust passage 26, to the exhaust manifold 70. The exhaust lines of at least two cylinders may be merged to form an overall exhaust line within the cylinder head, so as to form an integrated exhaust manifold that permits the densest possible packaging of the drive unit. In some embodiments, the exhaust lines of the at least two outlet openings of each cylinder are merged to form a partial exhaust line associated with the cylinder, before the partial exhaust lines of at least two cylinders are merged to form an overall exhaust line. The exhaust gasses may pass through one or more aftertreatment devices (not shown) before exiting to the atmosphere.

The overall length of all the exhaust lines is further shortened in this way. The stepped merging of the exhaust lines to form an overall exhaust line also contributes to a more compact, that is to say less voluminous design of the cylinder head, and therefore in particular to a weight reduction and more effective packaging in the engine bay.

Figure 4:
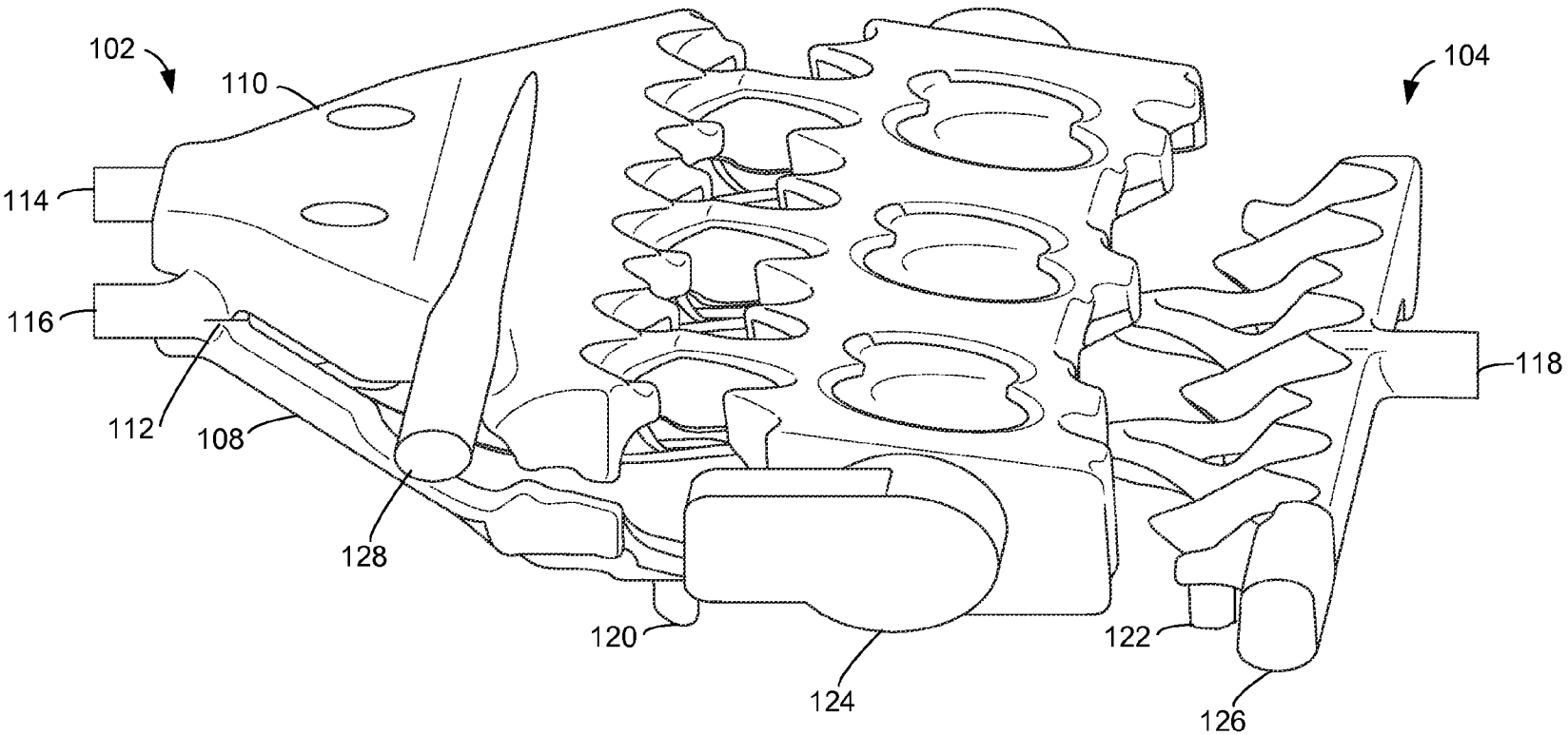
FIG. 4 schematically shows a plan view of example sand cores for forming coolant jackets.

In the case of an integrated manifold, the at least one connection described in reference to FIG. 1 and illustrated in FIG. 4 is preferably arranged adjacent to the region in which the exhaust lines merge to form an overall exhaust line, with the spacing between the at least one connection and the overall exhaust line preferably being smaller than the diameter or radius of a cylinder. The spacing is defined as the distance between the outer wall of the overall exhaust line and the outer wall of the connection.

The engine 10 may be supercharged by means of an exhaust-gas turbocharger. The exhaust gas may pass through a turbine 72 to drive a compressor 74 to provide boosted intake air to engine 10.

Here, it is sought firstly to arrange the turbine 72 as close as possible to an outlet of the internal combustion engine 10 in order thereby to be able to optimally utilize the exhaust-gas enthalpy of the hot exhaust gases and to ensure a fast response behavior of the turbocharger. Secondly, the path of the hot exhaust gases to the different exhaust-gas aftertreatment systems may also be as short as possible such that the exhaust gases are given little time to cool down and the exhaust-gas aftertreatment systems reach their operating temperature or light-off temperature as quickly as possible, in particular after a cold start of the internal combustion engine.

FIG. 4 shows a slightly inclined plan view of sand cores 102, 104 used to form cooling jackets, e.g. the coolant jackets 54, 56 discussed with regard to FIG. 1, of two coolant circuits which are separate from one another, such as are integrated, according to a first embodiment, in the cylinder head 12 of the internal combustion engine 10.

The sand cores 102, 104 shown here are those of a three-cylinder in-line engine, such as engine 10, in which each cylinder has, at the outlet side, two outlet openings for discharging the exhaust gases out of the cylinders, and at the inlet side, two inlet openings for the supply of fresh air to the cylinders, with an exhaust line being connected to each outlet opening and an intake line being connected to each inlet opening. The exhaust lines of the three cylinders merge to form an overall exhaust line within the cylinder head, so as to form an integrated exhaust manifold.

In FIG. 4, the inlet-side sand core 104, which forms the inlet side coolant jacket of the oil circuit, is arranged between the assembly end side and the intake lines. The outlet-side sand core 102, which forms two outlet-side coolant jackets of the water circuit, comprises a lower sand core 108 and an upper sand core 110, of which a lower sand core 108 is arranged between the assembly end side and the integrated exhaust manifold, and an upper sand core 110 is arranged on that side of the exhaust manifold which is situated opposite the lower sand core 108. Consequently, the manifold is situated between the lower coolant jacket and the upper coolant jacket and is encased by said coolant jackets over a large area. The cooling water circuit does not comprise an inlet-side coolant jacket. On that side of the exhaust manifold which faces away from the cylinders and on which the overall exhaust line also emerges out of the cylinder head, two connections 112 are provided between the lower sand core 108 and the upper sand core 110, which connections serve to permit the passage of cooling water, wherein one connection 112 is visible in the plan view of FIG. 3.

The two connections 112 are arranged adjacent to the overall exhaust line, that is to say to that region of the manifold at which the exhaust lines merge and the cylinder head is thermally particularly highly loaded.

To remove the sand cores 102, 104 after the casting of the cylinder head, access ports 114, 116, 118 are provided which also serve as sand core supports during the casting process. The access ports 114, 116, 118 are closed off after the casting process. Such access ports 114, 116, 118 may however fundamentally also be used within the context of the liquid cooling for the supply and discharge of coolant to and from the coolant jackets or circuits.

The access ports 114, 116 are provided in the region of the two connections 112, via which the lower sand core 108 and the upper sand core 110 communicate with one another.

In the embodiment illustrated in FIG. 4, cooling water inlets 120 and cooling oil inlets 122 are formed on the side facing toward the assembly end side, which inlets are aligned substantially parallel to the cylinder longitudinal axes. In contrast, the associated coolant outlets 124, 126 run substantially parallel to the crankshaft longitudinal axis. A ventilation line 128 serves to ventilate the cooling water circuit.

Figure 5:
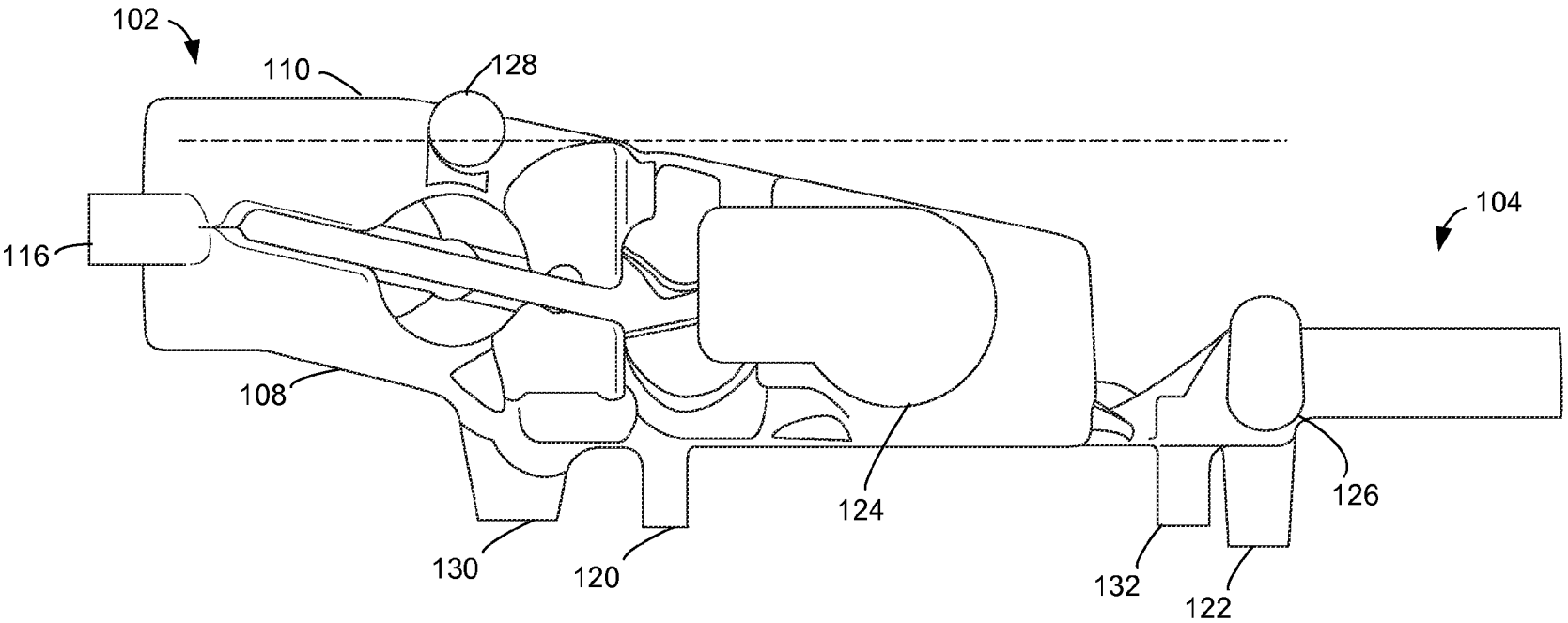
FIG. 5 schematically shows a side view of the example sand cores of FIG. 4.

FIG. 5 shows a side view of the sand cores 102, 104 illustrated in FIG. 4, with a view in the direction of the crankshaft longitudinal axis. It is sought merely to explain the additional features in relation to FIG. 4, for which reason reference is made otherwise to FIG. 4. The same reference signs are used for the same components.

It can be seen from FIG. 5 that, on the side facing toward the assembly end side, two cooling water inlets 120, 130 enter into the lower sand core 108 of the cooling water circuit, and two cooling oil inlets 122, 132 enter into the inlet-side sand core 104 of the oil circuit, and that the inlets 120, 130, 122, 132 run substantially parallel to the cylinder longitudinal axes.

It can be clearly seen that the lower and the upper sand cores 108, 110 are not connected to one another over the entire length of the manifold which is encased by them. The ventilation line 128 runs in the uppermost section of the cooling water circuit.

Figure 6:
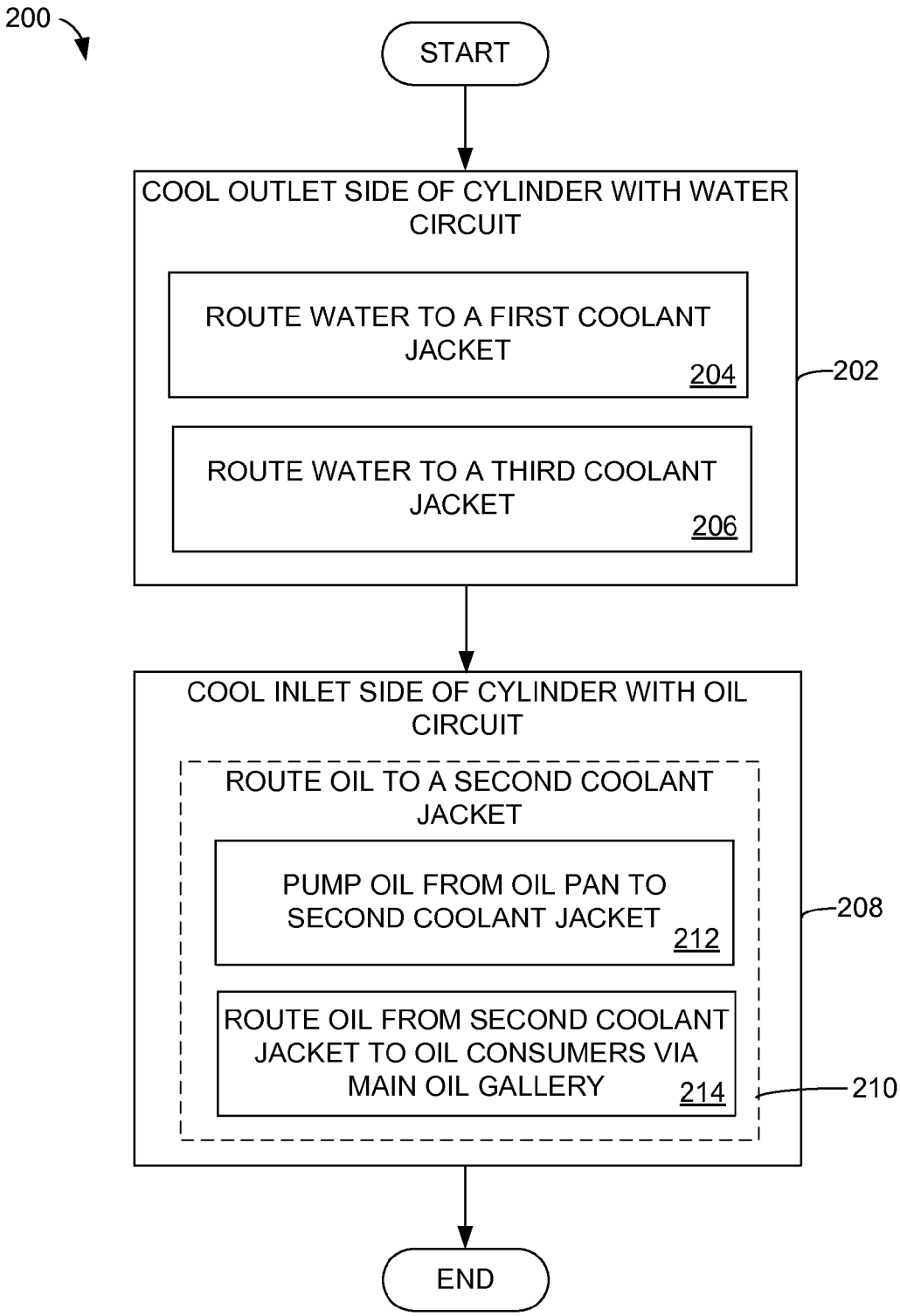
FIG. 6 is a flow chart illustrating a method for cooling an engine according to an embodiment of the present disclosure.

FIG. 6 is a flow chart illustrating a method 200 for cooling an engine. Method 200 comprises, at 202, cooling an outlet side of a cylinder via a water circuit. Cooling the outlet side of the cylinder further comprises, at 204, routing water to a first coolant jacket, such as coolant jacket 56, and, at 206, routing water to a third coolant jacket, such as coolant jacket 58. The first and third coolant jackets are arranged on the outlet side of the cylinder.

Method 200 comprises, at 208, cooling at inlet side of a cylinder via an oil circuit. Cooling the inlet side of the cylinder further comprises, at 210, routing oil to a second coolant jacket arranged on an inlet side of the cylinder, such as coolant jacket 54. At 212, oil is pumped from an oil pan to the second coolant jacket. At 214, method 200 comprises routing oil from the second coolant jacket to oil consumers via a main oil gallery.

It should be understand that the above described method is not intended to be carried out in a specific order. For example, cooling the outlet side of the cylinder and cooling the inlet side of the cylinder may occur simultaneously, by routing the water to the outlet side coolant jacket at the same as the oil is routed to the inlet side coolant jacket.

Thus, the systems and methods presented here may provide several advantages. By directing oil through an inlet-side coolant jacket, the oil may be quickly heated while maintaining an appropriate amount of cooling to the inlet side of a cylinder. Heated oil, or oil at a relatively high temperature, has a relatively low viscosity, which reduces the friction losses of the internal combustion engine and improves the efficiency. As a result, the fuel consumption of the internal combustion engine is noticeably reduced by the heating of the oil, in particular after a cold start.

The significant advantage of the approach described herein over concepts in which the oil is actively heated by means of a heating device lies in the comparatively simple design of the oil heating facility according to the disclosure. Basically no additional components are required, in particular no external heating device. The lack of a heating device also eliminates the additional fuel consumption generated by such a device. According to the disclosure, a coolant jacket provided to form a liquid cooling arrangement is assigned to an already existing oil circuit in order to be able to heat up the oil more quickly during a warm-up.

Further, the cooling of the outlet side of the cylinder head may additionally and advantageously be improved by virtue of a pressure gradient being generated between the upper and lower coolant jackets, as a result of which the speed in the at least one connection is increased, which leads to an increased heat transfer as a result of convection.

Here, the lower and upper coolant jackets may be connected to one another over their entire width or else in sections, that is to say over a partial region of the coolant jackets. In this way, it is possible to influence the flow speed in the at least one connection and therefore the heat transfer by convection.

It is to be understood that various steps or functions illustrated in the disclosure may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An internal combustion engine, comprising:

at least one cylinder, each cylinder having an outlet opening on an outlet side for discharging exhaust gases and an inlet opening on an inlet side for receiving fresh air;

at least one cylinder head; and a liquid cooling device comprising at least two coolant jackets integrated in the cylinder head, wherein at least one coolant jacket is arranged on the inlet side of the at least one cylinder and at least one coolant jacket is arranged on the outlet side and not on the inlet side of the at least one cylinder, the at least two coolant jackets being separate from one another and belonging to different coolant circuits.

2. The internal combustion engine of claim 1, further comprising:

a cooling water circuit comprising the at least one coolant jacket arranged on the outlet side and not on the inlet side; and an oil circuit comprising the at least one coolant jacket arranged on the inlet side.

3. The internal combustion engine of claim 2, wherein the cooling water circuit does not comprise an inlet-side coolant jacket.

4. The internal combustion engine of claim 2, wherein the at least one cylinder head is connected, at an assembly end side, to a cylinder block which serves as an upper crankcase half for holding a crankshaft in at least two bearings and which, at a side facing away from the cylinder head, is connected to an oil pan which serves as a lower crankcase half and which is provided for collecting and storing engine oil, with a pump being provided for feeding the engine oil via a supply line to at least one oil consumer within the oil circuit.

5. The internal combustion engine of claim 4, wherein the supply line opens out into a main oil gallery from which ducts lead to the at least two bearings of the crankshaft in order to supply the at least two bearings with engine oil.

6. The internal combustion engine of claim 5, wherein, upstream of the main oil gallery, the supply line leads through the cylinder head.

7. The internal combustion engine of claim 5, wherein, downstream of the pump, the supply line of the oil circuit firstly leads through the cylinder head before said supply line enters into the cylinder block.

8. The internal combustion engine of claim 1, wherein the cylinder head is connected, at an assembly end side, to a cylinder block which, to form a liquid cooling arrangement, has at least one coolant jacket.

9. The internal combustion engine of claim 8, wherein the at least one coolant jacket of the cylinder block belongs to a cooling water circuit.

10. The internal combustion engine of claim 8, wherein the at least one coolant jacket of the cylinder block belongs to a oil circuit.

11. The internal combustion engine of claim 8, wherein the at least one coolant jacket of the cylinder block is arranged upstream of the at least one coolant jacket of the cylinder head.

12. The internal combustion engine of claim 1, further comprising a cylinder block connected to the at least one cylinder head at an assembly end side of the cylinder head and an intake line connected to each inlet opening, wherein the at least one inlet-side coolant jacket is arranged between the assembly end side and the intake line.

13. The internal combustion engine of claim 1, further comprising a cylinder block connected to the at least one cylinder head at an assembly end side of the cylinder head and an exhaust line connected to each outlet opening, wherein the at least one outlet-side coolant jacket is arranged between the assembly end side and the exhaust line.

14. The internal combustion engine of claim 1, further comprising a cylinder block connected to the at least one cylinder head at an assembly end side of the cylinder head and an exhaust line connected to each outlet opening, wherein at least two outlet-side coolant jackets are provided, with a lower coolant jacket being arranged between the assembly end side and the exhaust line, and with an upper coolant jacket being arranged on that side of the exhaust line which is situated opposite the lower coolant jacket.

15. The internal combustion engine of claim 1, further comprising at least two cylinders in which an exhaust line is connected to each outlet opening, wherein the exhaust lines of the at least two cylinders merge to form an overall exhaust line within the cylinder head, so as to form an integrated exhaust manifold.

16. A method of cooling an engine comprising:

routing water through a first coolant jacket arranged on an outlet side and not on an inlet side of at least one cylinder of the engine; and routing oil through a second coolant jacket arranged on an inlet side of the at least one cylinder.

17. The method of claim 16, further comprising routing the oil from a pump to the second coolant jacket, the second coolant jacket leading to a main engine oil gallery.

18. The method of claim 16, further comprising routing water through a third coolant jacket arranged on the outlet side of the at least one cylinder.

19. A thermal control system for an internal combustion engine, comprising:

a water circuit comprising a first coolant jacket integrated into a cylinder head on an outlet side and not on an inlet side of at least one cylinder; and an oil circuit comprising a second coolant jacket integrated into the cylinder head on an inlet side of the at least one cylinder.

20. The system of claim 19, further comprising an oil pump configured to pump oil from an oil pan to the second coolant jacket, the second coolant jacket comprising an outlet coupled to a supply line for supplying the oil to a main engine oil gallery.

* * * * *